United States Patent [19]

Caldwell

[11] 4,162,694

[45] Jul. 31, 1979

[54] METHOD FOR AMELIORATING HAZARDOUS CONDITIONS ASSOCIATED WITH CONTAINERS WHICH CONTAIN VAPORS OF COMBUSTIBLE LIQUID

[76] Inventor: Oscar D. Caldwell, 2420 SW. 32nd, Oklahoma City, Okla. 73119

[21] Appl. No.: 815,916

[22] Filed: Jul. 15, 1977

[51] Int. Cl.[2] ..... B65B 3/04

[52] U.S. Cl. ..... 141/1; 29/401 E; 148/9 R; 228/219; 428/63

[58] Field of Search ..... 141/1–12, 141/65, 66, 52, 44, 45, 52, 59, 290, 392; 219/137 R, 74, 72, 34, 134; 228/219; 29/401 C, 401 E; 428/63; 148/9 R; 220/85 YR

[56] References Cited

U.S. PATENT DOCUMENTS

| | | | |
|---|---|---|---|
| 2,085,313 | 6/1937 | Guthrie | 228/219 |
| 2,985,129 | 5/1961 | Kirkpatrick | 228/219 |
| 3,292,254 | 12/1966 | Sloan | 228/219 |
| 3,597,833 | 8/1971 | Young et al. | 228/219 |
| 3,783,911 | 1/1974 | Husa et al. | 141/11 |

FOREIGN PATENT DOCUMENTS

| | | | |
|---|---|---|---|
| 2454774 | 5/1976 | Fed. Rep. of Germany | 228/219 |

*Primary Examiner*—Houston S. Bell
*Attorney, Agent, or Firm*—Dunlap, Codding & McCarthy

[57] ABSTRACT

The present invention provides a method for rendering the environment about a container containing vapors of a combustible liquid relatively safe for blacksmithing operations by introducing an oxygen-depleted gas into the container and removing the oxygen-depleted gas and the vapors of the combustible liquid from the container to displace oxygen from the container and reduce the hazard of explosion.

8 Claims, 2 Drawing Figures

METHOD FOR AMELIORATING HAZARDOUS CONDITIONS ASSOCIATED WITH CONTAINERS WHICH CONTAIN VAPORS OF COMBUSTIBLE LIQUID

BACKGROUND OF THE INVENTION

1. Field of the Invention

The present invention relates generally to methods for providing safe working environments for blacksmithing operations and, more particularly, but not by way of limitation to methods for reducing the hazards of explosions associated with blacksmithing operations on and about containers containing vapors of a combustible liquid.

2. Brief Description of the Prior Art

In the every day operation of automobiles, it is not uncommon for ruptures to occur in the gasoline tanks thereof. For example, corrosion might result in the development of leaks in an automobile gasoline tank or a traffic mishap might rupture such a gasoline tank. If the rupture is severe the gasoline tank is usually replaced. If, however, the rupture is minor, a more common remedy is to repair the tank by, for example, sealing the rupture via soldering or welding. In some cases a patch might be soldered or welded over the rupture to seal the gasoline tank.

The hazard associated with repairing a gasoline tank by these methods is well known. The gasoline tank will usually contain small amounts of gasoline, for example, in internal crevices, and this gasoline can vaporize and mix with air inside the tank to form an explosive mixture therewith. When heat is applied to the gasoline tank to apply solder or when an arc is struck to weld the tank, the explosive mixture can ignite. The resulting explosion can seriously injure the person repairing the gasoline tank.

The danger of injury from explosive mixtures of air and gasoline vapors is by no means restricted to the repair of the gasoline tanks of automobiles. Gasoline storage tanks, such as those used to store gasoline in service stations, can also be repaired by, for example, welding or soldering. It would not be unusual for such a tank to contain remnants of gasoline which can produce an explosive mixture with air. Similarly, railway tank cars might require repair by, for example, welding.

Moreover, fluids other than gasoline can evaporate to form explosive mixtures with air. A tank car which has contained an extremely flammable industrial compound, such as, naptha or xylene, presents the hazard of an explosion when repair is carried out thereon. Such industrial compounds will produce explosive mixtures with air and such mixtures can be ignited by welding equipment or even by sparks produced by impact between portions of the car and tools.

Another common situation presenting the danger of serious injury arising from the explosion of a mixture of air and vapors produced by a combustible liquid is the reclamation of metal drums which have been used to ship the liquid. Such drums are commonly reclaimed for use as refuse containers and for other uses by cutting away various parts of the drum with an acetylene cutting torch. Explosions of mixtures of air and vapors from the liquid previously shipped in such drums during such a salvage procedure are well known.

Thus, in general, containers of many kinds present a hazard when the container has previously been used to store or transport a flammable liquid. The hazard may be brought to fruition in a number of ways. Mechanical work on the container may produce a spark which ignites vapors therein or blacksmithing operations, such as welding, soldering or cutting may ignite the vapors.

SUMMARY OF THE INVENTION

The present invention contemplates the use of an oxygen-depleted gas to ameliorate the hazardous conditions associated with such containers. The oxygen-depleted gas, which can be the exhaust gases from an internal combustion engine, are introduced into the container and permitted to escape therefrom to replace the explosive atmosphere within the container with a non-explosive atmosphere.

An object of the present invention is to provide a method for reducing the hazards associated with containers which have been used to store or transport flammable liquids.

Another object of the present invention is to provide a method for reducing such hazards with the use of equipment which is readily available.

Yet another object of the invention is to provide an economical and convenient method for reducing the hazards associated with containers which have been used to store or transport flammable liquids.

Other objects and advantages of the invention will be evident from the following detailed description when read in conjunction with the accompanying drawings.

DESCRIPTION OF THE PREFERRED EMBODIMENTS

Figure 1:
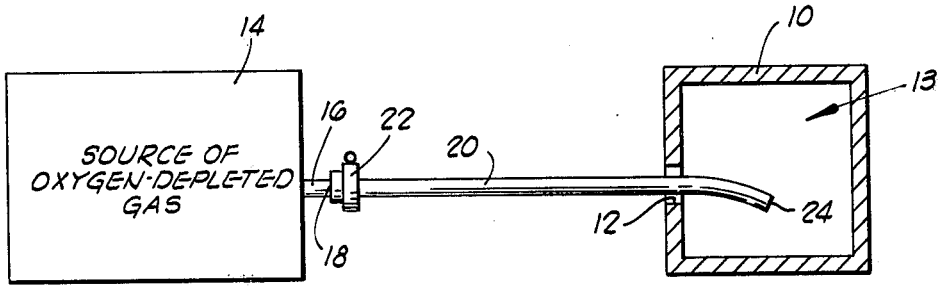
FIG. 1 is a schematic drawing illustrating the method of the present invention.

Referring to the drawings in general, and to FIG. 1 in particular, shown therein and designated by the general reference numeral 10 is a container, which has been previously used to contain a flammable liquid and which includes an opening 12 formed through a portion thereof and providing communication between an interior 13 of the container 10 and the surrounding environment. The opening 12 can be any opening in the container 10 which has been used to store or transport a flammable liquid. Examples of an opening in a container, such as the opening 12 in the container 10, would include the bung hole of a barrel, the inlet of a gasoline storage tank and a port on a railway tank car, such examples being provided solely for the purpose of describing the present invention and not by way of limitation.

In order to practice the method of the present invention, a source 14 of an oxygen-depleted gas is provided. Since the method of the present invention contemplates reduction of the oxygen content within the interior 13 of the container 10 with respect to the oxygen content of air, the term oxygen-depleted gas means any gas having an oxygen content lower than the oxygen content of air. Examples of an oxygen-depleted gas would be the exhaust fumes of an external combustion engine and any gas, such as nitrogen or carbon dioxide, for example, which may be commercially available for industrial purposes. Thus, the source 14 would include an internal combustion engine and would include a cylinder of pressurized gas.

The source 14 has an outlet 16 and one end 18 of a conduit 20 is connected to the outlet 16 via a fastener 22. It has been found to be convenient for the conduit 20 to be a length of rubber or plastic tubing and the fastener 22, in such a case, could be a hose clamp, such as a hose clamp commonly utilized in connection with automotive cooling systems. An end 24 of the conduit 20, opposite the end 18, is inserted into the interior 13 of the container 10 via the opening 12 to establish fluid communication between the source 14 and the interior 13 of the container 10 via the conduit 20.

In practice the source 14 is positioned adjacent or near the container 10, by transporting the container 10 to a position near the source 14, for example. The end 18 of the conduit 20 is connected to the source 14 and the end 24 of the conduit 20 is inserted into the interior 13 of the container 10 via the opening 12 to establish fluid communication between the source 14 and the interior 13 of the container 10.

The oxygen-depleted gas is introduced into the interior 13 of the container 10 via the conduit 20. In particular, when the invention is practiced by using a cylinder of commercially available gas for the source 14, the introduction of the oxygen-depleted gas into the container 10 is initiated by opening a valve on the cylinder which contains the gas. The oxygen-depleted gas passes from the source 14 to the interior 13 of the container 10 via the conduit 20 to establish a slight overpressure within the container 10 with respect to barometic pressure, i.e. the pressure level within the interior 13 of the container 10 is slightly higher than the pressure level of the surrounding environment. The conduit 20 is selected such that the diameter thereof is smaller than the diameter of the opening 12 in the container 10 so that the overpressure established by passing the oxygen-depleted gas into the container 10 may be relieved at the opening 12. Accordingly, a flow of oxygen-depleted gas is established from the source 14 into the interior 13 of the container 10, and the oxygen-depleted gas and the vapors of the combustible liquid are permitted to escape from the interior 13 of the container 10 via the opening 12.

As the oxygen-depleted gas passes into the interior 13 of the container 10, the air and vapors within the interior 13 of the container 10 are displaced therefrom such that the oxygen content of the environment within the interior 13 of the container 10 is reduced. Thus, the introduction of the oxygen-depleted into the container 10 ameliorates the hazardous conditions associated with the flammable vapors by removing a substantial portion of the oxygen from the interior 13 of the container 10 such that the oxygen content within the interior 13 of the container 10 will be insufficient to support an explosive combustion of the vapors. Moreover, by introducing the oxygen-depleted gas into the interior 13 of the container 10 and permitting gases from the interior 13 of the container 10 to escape therefrom, the amount of combustible vapors within the container 10 is also reduced. Thus, the hazardous conditions associated with the container 10 are further ameliorated by removing combustible vapors therefrom as well as removing therefrom oxygen which could combine explosively with such vapors.

The introduction of oxygen-depleted gas into the container 10 is continued for a period of time sufficient to substantially replace the oxygen within the interior 13 of the container 10 with the oxygen-depleted gas. Experience has shown that a period not exceeding forty-five minutes is sufficient when the container 10 is a fifty-five gallon drum and when the source 14 is an internal combustion engine suitable for powering a standard size automobile. Once the air within the container 10 has been replaced by the oxygen-depleted gas, blacksmithing operations may be carried out or performed with substantially reduced danger of an explosion of the gases within the container 10. The term "blacksmithing" as used herein includes mechanical operations which may produce sparks and operations such as welding, soldering, acetylene cutting, and other operations wherein a spark might be produced or wherein portions of the container 10 are heated, for example.

Figure 2:
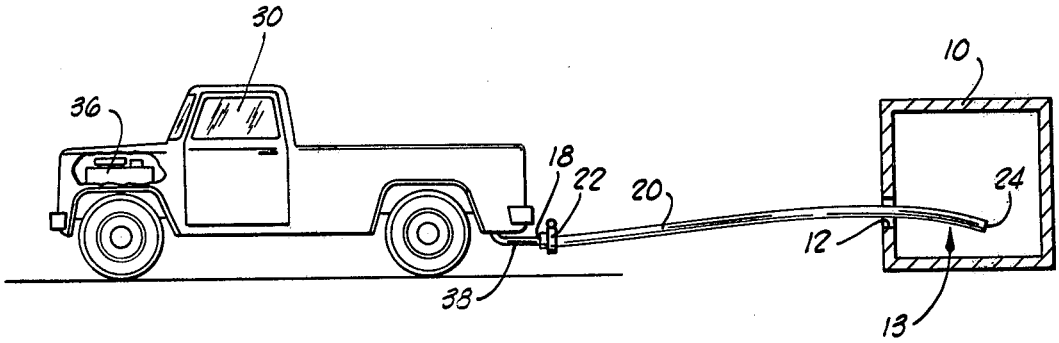
FIG. 2 is a schematic drawing illustrating one particular embodiment employing the method of the present invention.

FIG. 2 illustrates a particular embodiment for utilizing the method of the present invention which uses a readily available source of an oxygen-depleted gas. A vehicle 30 is positioned adjacent or near the container 10 which has contained a combustible fluid. The vehicle 30 has an internal combustion engine 36 which has an exhaust outlet 38. The end 18 of the conduit 20 is slipped over the exhaust outlet 38 and the conduit 20 is securedly connected to the exhaust outlet 38 via the fastener 22, such as a hose clamp, for example. The opposite end 24 of the conduit 20 is inserted through the opening 12 of the container 10 to provide fluid communication between the exhaust outlet 38 and the interior 13 of the container 10. The internal combustion engine 36 of the vehicle 30 is then operated to cause an oxygen-depleted gas, the exhaust fumes from the engine 36, to be emitted at the exhaust outlet 38. The exhaust fumes so produced are passed to the interior 13 of the container 10 to displace oxygen therefrom and to remove vapors of a combustible liquid therefrom as has been previously described.

It will be clear that the present invention provides a method which permits containers which have been used to store or transport combustible liquids to be subjected to blacksmithing operations while amelorating the hazards previously associated with such containers.

Changes may be made in the steps of the method as disclosed herein without departing from the spirit and scope of the invention as defined in the following claims.

What is claimed is:

1. A method for ameliorating the hazardous conditions associated with containers which contain, within an interior thereof, vapors of combustible liquids, comprising the steps of:

introducing an oxygen-depleted gas into the interior of the container, comprising the steps of:

providing a source of the oxygen-depleted gas;

establishing fluid communication between the source of the oxygen-depleted gas and the interior of the container; and passing the oxygen-depleted gas from the source into the interior or the container;

permitting the oxygen-depleted gas and vapors of combustible liquids to escape from the container; and maintaining the introducing of oxygen-depleted gas and the permitting of the oxygen-depleted gas and the vapors of the combustible liquids to escape from the container for a period of time sufficient to render the environment about the container relatively safe for blacksmithing operations.

2. The method of claim 1 wherein the step of establishing fluid communication between the source of the oxygen-depleted gas and the interior of the container is defined further to comprise the steps of:

connecting one end of a conduit to the source of the oxygen-depleted gas; and establishing fluid communication between the interior of the container and the end of the conduit opposite the end connected to the source of the oxygen-depleted gas, thereby establishing fluid communication between the source of oxygen-depleted gas and the interior of the container via the conduit.

3. The method of claim 2 wherein the step of establishing fluid communication between the container and the conduit comprises the step of:

inserting the end of the conduit opposite the end of the conduit connected to the source of oxygen-depleted gas into the interior of the container.

4. The method of claim 1 wherein the step of providing a source of oxygen-depleted gas is defined further to comprise the step of:

providing an internal combustion engine having an exhaust outlet; and operating the internal combustion engine to emit the oxygen-depleted gas at the exhaust outlet.

5. The method of claim 4 wherein the step of providing an internal combustion engine having an exhaust outlet is defined further to comprise the steps of:

providing an automotive vehicle; and positioning the automotive vehicle near the container.

6. The method of claim 5 further characterized as being a method for ameliorating the hazardous conditions of blacksmithing containers.

7. The method of claim 5 defined further to include the step of:

performing blacksmithing operations near the container.

8. The method of claim 5 defined further to include the step of:

performing blacksmithing operations on portions of the container.

* * * * *

UNITED STATES PATENT OFFICE

CERTIFICATE OF CORRECTION

Patent No. 4,162,694 Dated July 31, 1979

Inventor(s) Oscar D. Caldwell

It is certified that error appears in the above-identified patent and that said Letters Patent are hereby corrected as shown below:

In column 4, line 48, delete the word "amelorating" and substitute therefor-- "ameliorating".

In column 6, line 12, delete the word "amelorating" and substitute therefor-- "ameliorating".

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*